US007207390B1

(12) United States Patent
Pratt

(10) Patent No.: US 7,207,390 B1
(45) Date of Patent: Apr. 24, 2007

(54) METHOD AND SYSTEM FOR LINING MULTILATERAL WELLS

(75) Inventor: Christopher Arnold Pratt, Cochrane (CA)

(73) Assignee: CDX Gas, LLC, Dallas, TX (US)

( * ) Notice: Subject to any disclaimer, the term of this patent is extended or adjusted under 35 U.S.C. 154(b) by 119 days.

(21) Appl. No.: 10/772,841

(22) Filed: Feb. 5, 2004

(51) Int. Cl.
*E21B 23/03* (2006.01)

(52) U.S. Cl. ..... 166/313; 166/50; 166/117.6

(58) Field of Classification Search ..... 166/51, 166/313, 117.6, 50
See application file for complete search history.

(56) References Cited

U.S. PATENT DOCUMENTS

| | | | | |
|---|---|---|---|---|
| 54,144 | A | 4/1866 | Hamar | |
| 274,740 | A | 3/1883 | Douglass | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,488,106 | A | 3/1924 | Fitzpatrick | |
| 1,520,737 | A | 12/1924 | Wright | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,397,070 | A | 3/1946 | Zublin | |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |

(Continued)

FOREIGN PATENT DOCUMENTS

| | | |
|---|---|---|
| CA | 2 278 735 | 1/1998 |

(Continued)

OTHER PUBLICATIONS

R.C. Smith, et al., "*The Lateral Tie-Back System: The Ability to Drill and Case*", presented at the 1994 IADC/SPE Drilling Conference held in Dallas Texas, Feb. 15-18, 1994 pp. 55-66.

(Continued)

*Primary Examiner*—David Bagnell
*Assistant Examiner*—Daniel P. Stephenson
(74) *Attorney, Agent, or Firm*—Fish & Richardson P.C.

(57) ABSTRACT

In accordance with one embodiment of the present invention, a method for lining a lateral wellbore includes drilling a main wellbore extending from a surface to a subterranean zone, casing the main wellbore with a main casing having a plurality of lateral wellbore windows formed therein, positioning a whipstock having a longitudinal bore running therethrough adjacent a respective one of the lateral wellbore windows, forming a lateral wellbore through the respective lateral wellbore window using the whipstock, lining the first lateral wellbore with a lateral liner and a portion of a tie-back assembly that has a pre-milled lateral wellbore window formed therein, aligning the pre-milled lateral wellbore window with the longitudinal bore, and coupling the tie-back assembly to the main casing.

34 Claims, 5 Drawing Sheets

U.S. PATENT DOCUMENTS

| | | | | |
|---|---|---|---|---|
| 2,726,847 | A | 12/1955 | McCune et al. | 255/1.6 |
| 2,783,018 | A | 2/1957 | Lytle | 251/25 |
| 2,797,893 | A | 7/1957 | McCune et al. | |
| 2,804,926 | A | 9/1957 | Zublin | |
| 2,847,189 | A | 8/1958 | Shook | 255/76 |
| 2,911,008 | A | 11/1959 | Du Bois | 137/625.31 |
| 2,980,142 | A | 4/1961 | Turak | 137/637.3 |
| 3,208,537 | A | 9/1965 | Scarborough | 175/53 |
| 3,215,204 | A | 11/1965 | Sims | |
| 3,347,595 | A | 10/1967 | Dahms et al. | 299/4 |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,684,041 | A | 8/1972 | Kammerer, Jr. et al. | 175/267 |
| 3,692,041 | A | 9/1972 | Bondi | 137/238 |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | 175/45 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,022,279 | A | 5/1977 | Driver | 166/271 |
| 4,037,658 | A | 7/1977 | Anderson | 166/272 |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,134,463 | A | 1/1979 | Allen | 175/53 |
| 4,156,437 | A | 5/1979 | Chivens et al. | 137/554 |
| 4,169,510 | A | 10/1979 | Meigs | 175/65 |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,224,989 | A | 9/1980 | Blount | 166/250 |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,303,127 | A | 12/1981 | Freel et al. | 166/266 |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,333,539 | A | 6/1982 | Lyons et al. | 175/61 |
| 4,354,558 | A | 10/1982 | Jageler et al. | |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,075 | A | 8/1983 | Wood et al. | |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,402,551 | A | 9/1983 | Wood et al. | |
| 4,407,376 | A | 10/1983 | Inoue | 175/267 |
| 4,415,205 | A | 11/1983 | Rehm et al. | |
| 4,437,706 | A | 3/1984 | Johnson | 299/7 |
| 4,442,476 | A | 4/1984 | Lenderking et al. | |
| 4,442,896 | A | 4/1984 | Reale et al. | 166/278 |
| 4,494,616 | A | 1/1985 | McKee | 175/67 |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,674,579 | A | 6/1987 | Geller et al. | 175/45 |
| 4,693,327 | A | 9/1987 | Dickinson et al. | |
| 4,699,224 | A | 10/1987 | Burton | |
| 4,702,314 | A | 10/1987 | Huang et al. | 166/245 |
| 4,705,431 | A | 11/1987 | Gadelle et al. | 405/267 |
| 4,715,440 | A | 12/1987 | Boxell et al. | 166/100 |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,807,704 | A | 2/1989 | Hsu et al. | |
| 4,830,105 | A | 5/1989 | Petermann | 166/241 |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/248 |
| 4,978,172 | A | 12/1990 | Schwoebel et al. | 299/12 |
| 5,012,877 | A | 5/1991 | Winters et al. | |
| 5,016,710 | A | 5/1991 | Renard et al. | 166/245 |
| 5,035,605 | A | 7/1991 | Dinerman et al. | 481/18 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |
| 5,082,054 | A | 1/1992 | Kiamanesh | 166/248 |
| 5,111,893 | A | 5/1992 | Kvello-Aune | 175/258 |
| 5,115,872 | A | 5/1992 | Brunet et al. | |
| 5,135,058 | A | 8/1992 | Millgard et al. | 175/71 |
| 5,148,875 | A | 9/1992 | Karlsson et al. | 175/62 |
| 5,165,491 | A | 11/1992 | Wilson | 175/62 |
| 5,168,942 | A | 12/1992 | Wydrinski | 175/50 |
| 5,174,374 | A | 12/1992 | Hailey | 166/55.8 |
| 5,193,620 | A | 3/1993 | Braddick | 166/382 |
| 5,194,859 | A | 3/1993 | Warren | 340/853.4 |
| 5,197,553 | A | 3/1993 | Leturno | 175/57 |
| 5,197,783 | A | 3/1993 | Theimer et al. | 299/17 |
| 5,199,496 | A | 4/1993 | Redus et al. | 166/366 |
| 5,201,817 | A | 4/1993 | Hailey | 175/269 |
| 5,217,076 | A | 6/1993 | Masek | 166/303 |
| 5,226,495 | A | 7/1993 | Jennings et al. | 166/278 |
| 5,240,350 | A | 8/1993 | Yamaguchi et al. | 405/143 |
| 5,242,017 | A | 9/1993 | Hailey | 166/55.8 |
| 5,242,025 | A | 9/1993 | Neill et al. | 175/26 |
| 5,246,273 | A | 9/1993 | Rosar | 299/4 |
| 5,255,741 | A | 10/1993 | Alexander | 166/278 |
| 5,271,472 | A | 12/1993 | Leturno | 175/107 |
| 5,301,760 | A | 4/1994 | Graham | 175/61 |
| 5,311,936 | A | 5/1994 | McNair et al. | |
| 5,318,121 | A | 6/1994 | Brockman et al. | |
| 5,318,122 | A | 6/1994 | Murray et al. | |
| 5,322,127 | A | 6/1994 | McNair et al. | |
| 5,325,924 | A | 7/1994 | Bangert et al. | |
| 5,353,876 | A | 10/1994 | Curington et al. | |
| 5,363,927 | A | 11/1994 | Frank | 175/67 |
| 5,385,205 | A | 1/1995 | Hailey | 166/55.8 |
| 5,388,648 | A | 2/1995 | Jordan, Jr. | |
| 5,394,950 | A | 3/1995 | Gardes | 175/45 |
| 5,402,851 | A | 4/1995 | Baiton | 166/369 |

5,411,082 A 5/1995 Kennedy ..... 166/181
5,411,085 A 5/1995 Moore et al. ..... 166/242
5,411,088 A 5/1995 LeBlanc et al. ..... 166/265
5,411,104 A 5/1995 Stanley ..... 175/65
5,411,105 A 5/1995 Gray ..... 175/69
5,431,220 A 7/1995 Lennon et al. ..... 166/55.7
5,431,223 A 7/1995 Koopczynski
5,435,400 A 7/1995 Smith ..... 175/61
5,439,051 A 8/1995 Kennedy et al.
5,447,416 A 9/1995 Wittrisch ..... 417/442
5,450,902 A 9/1995 Matthews ..... 166/268
5,454,419 A 10/1995 Vloedman ..... 166/277
5,458,209 A 10/1995 Hayes et al.
5,462,116 A 10/1995 Carroll ..... 166/249
5,462,120 A 10/1995 Gondouin ..... 166/380
5,469,155 A 11/1995 Archambeault et al. . 340/853.4
5,474,131 A 12/1995 Jordan, Jr. et al.
5,477,923 A 12/1995 Jordan, Jr. et al. ..... 66/313
5,477,925 A 12/1995 Trahan et al.
5,485,089 A 1/1996 Kuckes ..... 324/346
5,494,121 A 2/1996 Nackerud ..... 175/263
5,499,687 A 3/1996 Lee ..... 175/317
5,501,273 A 3/1996 Puri ..... 166/252.5
5,501,279 A 3/1996 Garg et al. ..... 166/372
5,520,252 A 5/1996 McNair
5,584,605 A 12/1996 Beard et al. ..... 405/128
5,613,242 A 3/1997 Oddo ..... 588/17
5,615,739 A 4/1997 Dallas ..... 166/306
5,653,286 A 8/1997 McCoy et al. ..... 166/105.5
5,669,444 A 9/1997 Riese et al. ..... 166/263
5,680,901 A 10/1997 Gardes ..... 166/313
5,690,390 A 11/1997 Bithell ..... 299/4
5,706,871 A 1/1998 Anderson et al. ..... 141/59
5,720,356 A 2/1998 Gardes ..... 175/62
5,727,629 A 3/1998 Blizzard, Jr. et al. ..... 166/298
5,735,350 A 4/1998 Longbottom et al. ..... 166/313
5,771,976 A 6/1998 Talley ..... 166/370
5,775,433 A 7/1998 Hammett et al. ..... 166/98
5,785,133 A 7/1998 Murray et al. ..... 175/61
5,832,958 A 11/1998 Cheng ..... 137/625.41
5,853,054 A 12/1998 McGarian et al. ..... 175/267
5,853,056 A 12/1998 Landers ..... 175/424
5,853,224 A 12/1998 Riese ..... 299/13
5,863,283 A 1/1999 Gardes ..... 588/250
5,868,202 A 2/1999 Hsu ..... 166/256
5,868,210 A 2/1999 Johnson et al. ..... 175/40
5,879,057 A 3/1999 Schwoebel et al. ..... 299/17
5,884,698 A 3/1999 Hughes et al.
5,884,704 A 3/1999 Longbottom et al. ..... 16/313
5,917,325 A 6/1999 Smith ..... 324/326
5,934,390 A 8/1999 Uthe ..... 175/67
5,938,004 A 8/1999 Roberts et al. ..... 198/812
5,941,308 A 8/1999 Malone et al. ..... 166/313
5,944,108 A 8/1999 Baugh et al.
5,957,539 A 9/1999 Durup et al. ..... 299/4
5,971,074 A 10/1999 Longbottom et al. ..... 166/313
5,992,524 A 11/1999 Graham
6,012,516 A 1/2000 Brunet
6,012,520 A 1/2000 Yu et al. ..... 166/245
6,012,526 A 1/2000 Jennings et al.
6,015,012 A 1/2000 Reddick ..... 166/313
6,024,171 A 2/2000 Montgomery et al. ..... 166/308
6,047,774 A 4/2000 Allen
6,050,335 A 4/2000 Parsons ..... 166/272.3
6,053,254 A 4/2000 Gano
6,056,059 A 5/2000 Ohmer ..... 166/313
6,065,209 A 5/2000 Gondouin
6,065,550 A 5/2000 Gardes ..... 166/62
6,070,671 A 6/2000 Cumming et al.
6,079,488 A 6/2000 Begg et al.
6,089,320 A 7/2000 LaGrange
6,119,771 A 9/2000 Gano et al. ..... 166/50
6,135,208 A 10/2000 Gano et al. ..... 166/313
6,145,593 A 11/2000 Hennig
6,170,573 B1 1/2001 Brunet et al.
6,179,054 B1 1/2001 Stewart ..... 166/105.5
6,186,233 B1 2/2001 Brunet
6,199,633 B1 3/2001 Longbottom
6,199,635 B1 3/2001 Brunet et al.
6,209,636 B1 4/2001 Roberts et al. ..... 166/117.6
6,209,644 B1 4/2001 Brunet
6,209,648 B1 4/2001 Ohmer et al.
6,244,337 B1 6/2001 Cumming et al.
6,253,846 B1 7/2001 Nazzai et al.
6,263,968 B1 7/2001 Freeman et al.
6,279,659 B1 8/2001 Brunet
6,280,000 B1 * 8/2001 Zupanick ..... 299/12
6,283,216 B1 9/2001 Ohmer
6,315,054 B1 11/2001 Brunet
6,349,769 B1 2/2002 Ohmer ..... 166/313
6,357,523 B1 3/2002 Zupanick ..... 166/52
6,357,530 B1 3/2002 Kennedy et al. ..... 166/369
6,419,026 B1 7/2002 MacKenzie et al.
6,425,448 B1 7/2002 Zupanick et al. ..... 175/61
6,439,320 B2 8/2002 Zupanick ..... 166/313
6,450,256 B2 9/2002 Mones ..... 166/250.01
6,454,000 B1 9/2002 Zupanick ..... 166/243
6,457,540 B2 10/2002 Gardes ..... 175/62
6,464,001 B1 10/2002 Braithwaite et al.
6,478,085 B2 11/2002 Zupanick ..... 166/50
6,497,556 B2 12/2002 Zupanick ..... 417/85
6,536,531 B2 3/2003 Brunet
6,543,552 B1 4/2003 Metcalfe et al.
6,547,006 B1 4/2003 Kuck et al.
6,561,279 B2 5/2003 MacKenzie et al.
6,561,288 B2 5/2003 Zupanick ..... 175/69
6,566,649 B1 5/2003 Mickael ..... 250/269.3
6,568,469 B2 5/2003 Ohmer et al.
6,571,888 B2 6/2003 Comeau ..... 175/61
6,575,235 B2 6/2003 Zupanick ..... 166/50
6,577,129 B1 6/2003 Thompson ..... 324/338
6,585,061 B2 7/2003 Radzinski ..... 175/45
6,590,202 B2 7/2003 Mickael ..... 250/269.4
6,591,903 B2 7/2003 Ingle ..... 166/50
6,598,686 B1 7/2003 Zupanick ..... 175/62
6,604,580 B2 8/2003 Zupanick ..... 166/245
6,604,910 B1 8/2003 Zupanick ..... 417/36
6,607,042 B2 8/2003 Hoyer ..... 175/38
6,622,792 B1 9/2003 Schick
6,636,159 B1 10/2003 Winnacker ..... 340/854.3
6,639,210 B2 10/2003 Odom et al. ..... 250/269.6
6,646,441 B2 11/2003 Thompson et al. ..... 324/338
6,653,839 B2 11/2003 Yuratich et al. ..... 324/355
6,662,870 B1 12/2003 Zupanick ..... 166/245
6,668,918 B2 12/2003 Zupanick ..... 166/50
6,679,322 B1 1/2004 Zupanick ..... 166/50
6,681,855 B2 1/2004 Zupanick ..... 166/50
6,688,388 B2 2/2004 Zupanick ..... 166/50
6,732,801 B2 5/2004 Ohmer et al.
6,752,211 B2 6/2004 Dewey et al.
6,766,859 B2 7/2004 Haugen et al.
6,786,282 B2 9/2004 Begg et al.
6,923,275 B2 8/2005 Gardes
2002/0000319 A1 * 1/2002 Brunet ..... 166/313
2002/0023747 A1 2/2002 Begg
2002/0050358 A1 5/2002 Algeroy ..... 166/313
2002/0070018 A1 6/2002 Buyaert
2002/0074120 A1 6/2002 Scott ..... 166/313
2002/0074122 A1 6/2002 Kelly et al. ..... 166/313
2002/0096336 A1 7/2002 Zupanick ..... 175/161
2002/0100588 A1 8/2002 Murray et al.
2002/0108746 A1 8/2002 Zupanick ..... 166/50
2002/0117297 A1 8/2002 Zupanick ..... 166/50
2002/0157826 A1 10/2002 MacKenzie et al.
2002/0189801 A1 12/2002 Zupanick ..... 166/50
2003/0062198 A1 4/2003 Gardes ..... 175/61

| | | | | |
|---|---|---|---|---|
| 2003/0066686 | A1 | 4/2003 | Conn | 175/57 |
| 2003/0075334 | A1 | 4/2003 | Haugen et al. | 166/313 |
| 2003/0106686 | A1 | 6/2003 | Ingle et al. | 166/245 |
| 2003/0217842 | A1 | 11/2003 | Zupanick et al. | |
| 2004/0007389 | A1 | 1/2004 | Zupanick | 175/61 |
| 2004/0007390 | A1 | 1/2004 | Zupanick | 175/61 |
| 2004/0011529 | A1 | 1/2004 | McGarian et al. | |
| 2004/0035581 | A1 | 2/2004 | Cavender | |
| 2004/0092404 | A1 | 5/2004 | Murray et al. | |
| 2004/0159435 | A1 | 8/2004 | Plucheck et al. | |
| 2004/0244992 | A1 | 12/2004 | Carter et al. | |
| 2005/0006100 | A1 | 1/2005 | Murray et al. | |
| 2005/0039915 | A1 | 2/2005 | Murray | |
| 2005/0241826 | A1 | 11/2005 | Pratt | |

FOREIGN PATENT DOCUMENTS

| | | | |
|---|---|---|---|
| DE | CH 653 741 | | 1/1986 |
| DE | 38 32 715 | A1 | 3/1990 |
| EP | 0 875 661 | A1 | 11/1998 |
| EP | 0 952 300 | A1 | 10/1999 |
| EP | 1249574 | A2 | 10/2002 |
| FR | 964503 | | 8/1950 |
| GB | 2 255 033 | | 10/1992 |
| GB | 2297 988 | | 8/1996 |
| GB | 2297988 | A | 8/1996 |
| GB | 2 318 817 | | 5/1998 |
| GB | 2 345 933 | | 7/2000 |
| GB | 2347157 | | 8/2002 |
| GB | 2 381 809 | | 5/2003 |
| RU | 750108 | | 6/1975 |
| RU | 1770570 | A1 | 3/1990 |
| SU | 750108 | | 6/1975 |
| SU | 1448078 | A1 | 3/1987 |
| SU | 1770570 | A1 | 3/1990 |
| WO | 94/21889 | | 9/1994 |
| WO | WO 98/09053 | | 3/1998 |
| WO | WO 98/35133 | | 8/1998 |
| WO | WO 99/60248 | | 11/1999 |
| WO | WO 00/26501 | | 5/2000 |
| WO | 00/31376 | | 6/2000 |
| WO | WO 00/79099 | | 12/2000 |
| WO | WO 01/44620 | | 6/2001 |
| WO | WO 01/90533 | A1 | 11/2001 |
| WO | WO 02/18738 | | 3/2002 |
| WO | WO 02/059455 | | 8/2002 |
| WO | WO 02/061238 | | 8/2002 |
| WO | WO 03/061238 | | 8/2002 |
| WO | WO 03/102348 | | 12/2003 |

OTHER PUBLICATIONS

E.Ross, "*Multilateral Thinking*", The New Technology Magazine, 1999, pp. 24-25.

Guntis Moritis, "*Complex Well Geometries Boost Orinoco Heavy Oil Producing Rates*", Oil & Gas Journal, Feb. 28, 2000, pp. 42-46.

Emerson, et al., "*Moving Toward Simpler, Highly Functional Multilateral Completions*", JCPT, May 2002, vol. 41, No. 5, pp. 912.

Karen Bybee, "*A New Generation Multilateral System for the Troll Oije Field*", presented originally at the 2001 SPE Offshore Europe, Aberdeen, Sep. 4-7, 2001, pp. 50-51.

Praful Desai, "*Innovative Design Allows Construction of Level 3 or Level 4 Junction Using the Same Platform*", © SPE/PS-CIM/CHOA International Thermal Operations and Heavy Oil Symposium and International Horizontal Well Technology Conference, held Nov. 4-7, 2002 in Calgary, Alberta, Canada, 11 pages.

Karen Bybee, "*Advanced Openhole Multilaterals*", presented at the 2002 IADC/SPE Asia Pacific Drilling Technology, Kakarta, Sep. 9-11, 2002, pp. 41-42.

Examiner of Record, Office Action Response regarding the Interpretation of the three Russian Patent Applications listed above under Foreign Patent Documents (9 pages), date unknown.

McCray and Cole, "Oil Well Drilling and Technology," University of Oklahoma Press, pp. 315-319, 1959.

Berger and Anderson, "Modern Petroleum;" Penn Well Books, pp. 106-108, 1978.

Arfon H. Jones et al., A Review of the Physical and Mechanical Properties of Coal with Implications for Coal-Bed Methane Well Completion and Production, Rocky Mountain Association of Geologists, pp. 169-181, 1988.

Howard L. Hartman, et al.; "SME Mining Engineering Handbook;" Society for Mining, Metallurgy, and Exploration, Inc.; pp. 1946-1950, 2nd Edition, vol. 2, 1992.

Dave Hassan, Mike Chernichen, Earl Jensen, and Morley Frank; "Multi-lateral technique lowers drilling costs, provides environmental benefits", Drilling Technology, pp. 41-47, Oct. 1999.

Gopal Ramaswamy, "Production History Provides CBM Insights," Oil & Gas Journal, pp. 49, 50 and 52, Apr. 2, 2001.

Weiguo Chi and Luwu Yang, "Feasibility of Coalbed Methane Exploration in China," Horizontal Well Technology, p. 74, Sep. 2001.

Nackerud Product Description, Harvest Tool Company, LLC, 1 page.

Gopal Ramaswamy, "Advanced Key for Coalbed Methane," The American Oil & Gas Reporter, pp. 71 & 73, Oct. 2001.

Joseph C. Stevens, Horizontal Applications For Coal Bed Methane Recovery, Strategic Research Institute, pp. 1-10 (slides), Mar. 25, 2002.

R.J. "Bob" Stayton, "Horizontal Wells Boost CBM Recovery", Special Report: Horizontal & Directional Drilling, The American Oil & Gas Reporter, pp. 71-75, Aug. 2002.

P. Jackson and S. Kershaw, Reducing Long Term Methane Emissions Resulting from Coal Mining, Energy Convers. Mgmt, vol. 37, Nos. 6-8, pp. 801-806, 1996.

Susan Eaton, "Reversal of Fortune", New Technology Magazine, pp. 30-31, Sep. 2002.

James Mahony, "A Shadow of Things to Come", New Technology Magazine, pp. 28-29, Sep. 2002.

Documents Received from Third Party, Great Lakes Directional Drilling, Inc., (12 pages).

Robert W. Taylor and Richard Russell, Multilateral Technologies Increase Operational Efficiencies in Middle East, Oil & Gas Journal, pp. 76-80, Mar. 16, 1998.

Adam Pasiczynk, "Evolution Simplifies Multilateral Wells", Directional Drilling, pp. 53-55, Jun. 2000.

Steven S. Bell, "Multilateral System with Full Re-Entry Access Installed", World Oil, p. 29, Jun. 1996.

Pascal Breant, "Des Puits Branches, Chez Total : les puits multi drains", Total Exploration Production, pp. 1-5, Jan. 1999.

Chi, Weiguo, "*A Feasible Discussion on Exploitation Coalbed Methane through Horizontal Network Drilling in China*", SPE 64709, Society of Petroleum Engineers (SPE International), 4 pages, Nov. 7, 2000.

Chi, Weiguo, "*Feasibility of Coalbed Methane Exploitation in China*", synopsis of paper SPE 64709, 1 page, Nov. 7, 2000.

Ian D. Palmer et al., "*Coalbed Methane Well Completions and Stimulations*", Chapter 14, pp. 303-339, Hydrocarbons from Coal, Published by the American Association of Petroleum Geologists, 1993.

Zupanick, U.S. Appl. No. 10/264,535, "Method and System for Removing Fluid From a Subterranean Zone Using an Enlarged Cavity", filed Aug. 15, 2003.

Notification of Transmittal of the International Search Report or the Declaration (PCT Rule 44.1) mailed Nov. 6, 2003 (8 pages) re International Application No. PCT/US 03/021626, Jul. 11, 2003.

Notification of Transmittal of the International Search Report or the Declaration (PCT Rule 44.1) mailed Nov. 5, 2003 (8 pages) re International Application No. PCT/US 03/21627, Jul. 11, 2003.

Notification of Transmittal of the International Search Report or the Declaration (PCT Rule 44.1) mailed Nov. 4, 2003 (7 pages) re International Application No. PCT/US 03/21628, Jul. 11, 2003.

Notification of Transmittal of the International Search Report or the Declaration (PCT Rule 44.1) mailed Dec. 5, 2003 (8 pages) re International Application No. PCT/US 03/21750, Jul. 11, 2003.

Notification of Transmittal of the International Search Report or the Declaration (PCT Rule 44.1) mailed Dec. 19, 2003 (8 pages) re International Application No. PCT/US 03/28137, filed Sep. 9, 2003.

Notification of Transmittal of the International Search Report or the Declaration (PCT Rule 44.1) mailed Feb. 4, 2004 (8 pages) re International Application No. PCT/US 03/26124, filed Sep. 9, 2003.
Smith, Maurice, "*Chasing Unconventional Gas Unconventionally*," CBM Gas Technology, New Technology Magazine, Oct./Nov. 2003, pp. 1-4.
Gardes, Robert, "*A Direction in Coalbed Methane and Shale Gas Recovery*," (to the best of Applicants' recollection, first received at The Canadian Institute Coalbed Methane Symposium conference on Jun. 16 and Jun. 17, 2002), 1 page of conference flyer, 6 pages of document.
Gardes, Robert, "*Under-Balance Multi-Lateral Drilling for Unconventional Gas Recovery*," (to the best of Applicants' recollection, first received at The Unconventional Gas Revolution conference on Dec. 9, 2003), 4 pages of conference flyer, 33 pages of document.
Boyce, Richard "*High Resolution Selsmic Imaging Programs for Coalbed Methane Development*," (to the best of Applicants' recollection, first received at The Unconventional Gas Revolution conference on Dec. 10, 2003), 4 pages of conference flyer, 24 pages of document.
Mark Mazzella and David Strickland, "*Well Control Operations on a Multiwell Platform Blowout*", WorldOil.com—Online Magazine Article, vol. 22, Part 1—pp. 1-7, and Part II—pp. 1-13, Jan. 2002.
Vector Magnetics LLC, Case History, California, May 1999, "*Successful Kill of a Surface Blowout*," pp. 1-12, May 1999.
Cudd Pressure Control, Inc, "*Successful Well Control Operations-A Case Study: Surface and Subsurface Well Intervention on a Multi-Well Offshore Platform Blowout and Fire*," pp. 1-17, http://www.cuddwellcontrol.com/literature/successful/successful_well.htm, 2000.
R. Purl, et al., "*Damage to Coal Permeability During Hydraulic Fracturing*," pp. 109-115 (SPE 21813), 1991.
U.S. Dept. of Energy—Office of Fossil Energy, "*Multi-Seam Well Completion Technology: Implications for Powder River Basin Coalbed Methane Production*," pp. 1-100, A-1 through A-10, Sep. 2003.
U.S. Dept. of Energy—Office of Fossil Energy, "*Powder River Basin Coalbed Methane Development and Produced Water Management Study*," pp. 1-111, A-1 through A-14, Sep. 2003.
Zupanick, U.S. Patent Application, entitled "Multi-Well Structure for Accessing Subterranean Deposits," U.S. Appl. No. 09/788,897, filed Feb. 20, 2001.
Zupanick, U.S. Patent Application, entitled "Slant Entry Well System and Method," U.S. Appl. No. 10/004,316, filed Oct. 30, 2001.
Zupanick, U.S. Patent Application, entitled "Method and System for Underground Treatment of Materials," U.S. Appl. No. 10/142,817, filed May 8, 2002.
Rial, U.S. Patent Application, entitled Method and System for Accessing a Subterranean Zone from a Limited Surface Area, U.S. Appl. No. 10/188,141, filed Jul. 1, 2002.
Zupanick, U.S. Patent Application, entitled "Undulating Well Bore", U.S. Appl. No. 10/194,366, filed Jul. 12, 2002.
Zupanick, U.S. Patent Application, entitled "Ramping Well Bores", U.S. Appl. No. 10/194,367, filed Jul. 12, 2002.
Zupanick, U.S. Patent Application, entitled "Wellbore Sealing System and Method," U.S. Appl. No. 10/194,368, filed Jul. 12, 2002.
Zupanick, U.S. Patent Application, entitled "Wellbore Sealing System and Method," U.S. Appl. No. 10/194,422, filed Jul. 12, 2002.
Zupanick, U.S. Patent Application, entitled "Wellbore Sealing System and Method," U.S. Appl. No. 10/406,037, filed Jul. 12, 2002.
Zupanick, U.S. Patent Application, entitled "System and Method for Subterranean Access", U.S. Appl. No. 10/227,057, filed Aug. 22, 2002.
Zupanick, U.S. Patent Application, "Method and System for Controlling Pressure in a Dual Well System", U.S. Appl. No. 10/244,082, filed Sep. 12, 2002.
Zupanick, U.S. Patent Application, entitled "Three-Dimensional Well System for Accessing Subterranean Zone", U.S. Appl. No. 10/244,083, filed Sep. 12, 2002.
Zupanick, U.S. Patent Application, entitled "Accelerated Production of Gas from a Subterranean Surface", U.S. Appl. No. 10/246,052, filed Sep. 17, 2002.
Zupanick, U.S. Patent Application, entitled "Method and System for Removing Fluid from a Subterranean Zone Using and Enlarged Cavity", U.S. Appl. No. 10/264,535, filed Oct. 3, 2002.
Zupanick, U.S. Patent Application, entitled "Method of Drilling Lateral Wellbores from a Slant Well Without Utilizing a Whipstock", U.S. Appl. No. 10/267,426, filed Oct. 8, 2002.
Zupanick, U.S. Patent Application, entitled "Method and System for Circulating Fluid in a Well System", U.S. Appl. No. 10/323,192, filed Dec 18, 2002.
Zupanick, U.S. Patent Application, entitled Method and System for Controlling the Production Rate . . . , U.S. Appl. No. 10/328,408, filed Dec. 23, 2002.
Rial, U.S. Patent Application entitled "Method and System for Recirculating Fluid in a Well System," U.S. Appl. No. 10/457,103, filed Jun. 5, 2003.
Zupanick, U.S. Patent Application, entitled "Three-Dimensional Well System for Accessing Subterranean Deposits from the Surface and Tools Therefor," U.S. Appl. No. 10/630,345, filed Jul. 29, 2003.
Zupanick, U.S. Patent Application, entitled "Method and System for Accessing Subterranean Deposits from the Surface," U.S. Appl. No. 10/641,856, filed Aug. 15, 2003.
Zupanick, U.S. Patent Application entitled "Method and System for Testing Partially Formed Hydrocarbon Well for Evaluation and Well Planning Refinement," U.S. Appl. No. 10/715,300, filed Nov. 17, 2003.
Seams, U.S. Patent Application, entitled "Method and System for Extraction of Resources from a Subterranean Well Bore," U.S. Appl. No. 10/723,322, filed Nov. 26, 2003.
Zupanick, U.S. Patent Application, entitled "Slant Entry Well System and Method," U.S. Appl. No. 10/749,884, filed Dec. 31, 2003.
Zupanick, U.S. Patent Application, entitled Method and System for Accessing a Subterranean Deposits from the Surface, U.S. Appl. No. 10/761,629, filed Jan. 20, 2004.
Zupanick, U.S. Patent Application, entitled "Method and System for Testing Partially Formed Hydrocarbon Well for Evaluation and Well Planning Refinement," U.S. Appl. No. 10/769,221, filed Jan. 30, 2004.
Notification of Transmittal of the International Search Report or the Declaration (PCT Rule 44.1) mailed Feb. 9, 2004 (6 pages) re International Application No. PCT/US 03/28138, Sep. 9, 2003.
Notification of Transmittal of the International Search Report or the Declaration (PCT Rule 44.1) mailed Feb. 27, 2004 (9 pages) re International Application No. PCT/US 03/30126, Sep. 23, 2003.
Fletcher, "Anadarko Cuts Gas Route Under Canadian River Gorge," Oil and Gas Journal, pp. 28-30, Jan. 25, 2004.
Translation of selected pages of Kalinin, et al., "Drilling Inclined and Horizontal Well Bores," Nedra Publishers, Moscow, 1997, 15 pages.
Translation of selected pages of Arens, V.Zh., "Well-Drilling Recovery of Minerals," Geotechnology, Nedra Publishers, Moscow, 7 pages, 1986.
Fipke, S., et al., "*Economical Multilateral Well Technology for Canadian Heavy Oil*," Petroleum Society, Canadian Institute of Mining, Metallurgy & Petroleum, Paper 2002-100, to be presented in Calgary Alberta, Jun. 11-13, 2002, pp. 1-11.
Themig, Dan, "*Multilateral Thinking*," New Technology Magazine, Dec. 1999, pp. 24-25.
B. Goktas et al., "*Performances of Openhole Completed and Cased Horizontal/Undulating Wells in Thin-Bedded, Tight Sand Gas Reservoirs*," SPE 65619, Society of Petroleum Engineers, Oct. 17-19, 2000 (7 pages).
Sharma, R., et al., "*Modeling of Undulating Wellbore Trajectories*," The Journal of Canadian Petroleum Technology, vol. 34, No. 10, XP-002261908, Oct. 18-20, 1993 pp. 16-24.
Balbinski, E.F., "*Prediction of Offshore Viscous Oil Field Performance*," European Symposium on Improved Oil Recovery, Aug. 18-20, 1999, pp. 1-10.
Zupanick, "Three-Dimentsional Well System For Accessing Subterranean Zones," filed Feb. 11, 2004, U.S. Appl. No. 10/777,503.
Oilfield Review, "Constructing Wellbore Junctions," Website: http://www.oilfield.slb.com/media/external/ori_2004q2/001_constructing.html, printed Mar. 8, 2005 (1 page).

Oilfield Review—Junction Classifications—PRINT, "Oilfield Review Interactive Multilateral Technology," Website: http://www.oilfield.slb.com/media/external/ori_2004q2/print/001b_JC_print.html, printed Mar. 8, 2005 (2 pages).
World Oil, "Evolution Toward Simpler, Less Risky Multilateral Wells—Statistical Data Included," Website; http://www.findarticles.com/p/articles/mi_m3159/is_6_222/ai_75918331/print, printed Feb. 24, 2005, copyright 2001 (7 pages).
World Oil, "Operators Take Advantage of Recent Innovation—Technology at Work—Oil Exploration Services Technology—Brief Article," Website: http://www.findarticles.com/p/articles/mi_m3159/is_2_223/ai_83669000/print, printed Feb. 24, 2005, copyright 2002 (10 pages).
Dick Ghiselin, "November: Production Optimization: Technology Scene at Offshore Europe," Hart's E&P Net, Website: http://www.eandpnet.com/ep/previous/1103/1103prod_optimization.htm, printed Feb. 24, 2005, Nov. 2003 (3 pages).
Dennis Denney, Highlights of paper SPE 87207, "Multilateral Wells Improve Development in Heavy Oil Field," Website: http://www.spe.org/spe/jpt/jsp/jptpaperssynopsis/0,2439,1104_11038_2557364_2585012,0..., printed Feb. 24, 2005, JPT Online, Jul. 2004, (4 pages).
Baker Hughes, "Multilateral Case History—Rotterdam 19, Level 4, The Netherlands," copyright 1999 (1 page).
Solutions From the Field, "Horizontal Drilling Helps Recovery Rates," Petroleum Technology Transfer Counsel, Website: http://www.pttc.org/solutions/20.htm, printed Feb. 24, 2005, copyright 2004 (4 pages).
Baker Oil Tools, "Multilaterals," Website: http://www.bakerhughes.com/bot/multilateral/index.htm, printed Mar. 8, 2005, copyright 2005 (2 pages).
Baker Oil Tools, "Liner Hangers," Website: http://www.bakerhughes.com/bot/liner_hangers/index.htm, printed Mar. 8, 2005, copyright 2005 (1 page).
Baker Hughes Geothermal, "Multilateral Technology," and Subpages from Website: http://www.bakerhughes.com/bakerhughes/geothermal/multilateral_tech.htm, printed Mar. 8, 2005, copyright 2005 (7 pages).
William P. Diamond, "Methane Control for Underground Coal Mines," IC-9395, Bureau of Mines Information Circular, United States Department of the Interior, 1994 (51 pages).
David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982, 56 pages.
Notification of Transmittal of the International Search Report and the Written Opinion of the International Searching Authority, or the Declaration (3 pages), International Search Report (6 pages) and Written Opinion of the International Searching Authority (5 pages) for International Application No. PCT/US2005/003354 mailed Apr. 20, 2005.
Pratt et al., U.S. Patent Application entitled "Lining Well Bore Junctions," U.S. Appl. No. 11/020,374, filed Dec. 22, 2004 (43 pages).
Pratt et al., U.S. Patent Application entitled, "Adjustable Window Liner," U.S. Appl. No. 11/021,055, filed Dec. 22, 2004 (45 pages).
Notification of Transmittal of the International Search Report and the Written Opinion of the International Searching Authority, or the Declaration (2 pages), International Search Report (5 pages), and Written Opinion of the International Searching Authority (7 pages) for International Application No. PCT/US2005/046986 mailed Apr. 24, 2006.
E.J. Antczak, et al., "*Implementation of an Advanced Multi-Lateral System With Coiled Tubing Accessibility*," SPE/IADC 37673, Society of Petroleum Engineers, Copyright 1997, 9 pages.
Notification Concerning Transmittal of Copy of International Preliminary Report on Patentability (Chapter I of the Patent Cooperation Treaty) (1 page), International Preliminary Report on Patentability (1 page), and Written Opinion of the International Searching Authority (4 pages) for International Application No. PCT/US2005/003354 mailed Aug. 17, 2006.

* cited by examiner

METHOD AND SYSTEM FOR LINING MULTILATERAL WELLS

TECHNICAL FIELD OF THE INVENTION

The present invention relates generally to accessing a subterranean zone from the surface for production and/or injection of gas or other fluids and, more particularly, to a method and system for lining multilateral wells.

BACKGROUND OF THE INVENTION

Subterranean deposits of coal, shale and other formations often contain substantial quantities of methane gas. Vertical wells and vertical well patterns have been used to access coal and shale formations to produce the methane gas. More recently, horizontal patterns and interconnected wellbores have also been used to produce methane gas from coal and shale formations and/or to sequester carbon dioxide. Limited production and use of methane gas from such formations has occurred for many years because substantial obstacles have frustrated extensive development and use of methane gas deposits in coal seams.

One such obstacle is the potential for collapse of the wellbore(s) during the production of the methane gas. A solution to this problem is to run casing/liners in the producing zone. A casing with properly sized openings prevents the collapsed coal from plugging the hole, which would prevent optimum production. The use of multiple wellbores from the same parent well also improve production, but this creates a new set of obstacles. A junction must be made between the main wellbore and the respective lateral wellbores. If solids production (coal) is anticipated this junction should allow access to both the lateral and the main wellbore below the lateral for clean out purposes, which can create obstacles in the completion

SUMMARY OF THE INVENTION

In accordance with one embodiment of the present invention, a method for lining a lateral wellbore includes drilling a main wellbore extending from a surface to a subterranean zone, casing the main wellbore with a main casing having a plurality of lateral wellbore windows formed therein, positioning a whipstock having a longitudinal bore running therethrough adjacent a respective one of the lateral wellbore windows, forming a lateral wellbore through the respective lateral wellbore window using the whipstock, lining the first lateral wellbore with a lateral liner and a portion of a tie-back assembly that has a pre-milled lateral wellbore window formed therein, aligning the pre-milled lateral wellbore window with the longitudinal bore, and coupling the tie-back assembly to the main casing.

In accordance with another embodiment of the present invention, a system for lining a lateral wellbore includes a main casing having a lateral wellbore window formed therein disposed within a main wellbore and a whipstock having a longitudinal bore running therethrough and disposed within the main wellbore adjacent the lateral wellbore window. The whipstock includes a deflecting surface for forming a lateral wellbore through the lateral wellbore window. The system further includes a tie-back assembly operable to dispose a lateral liner within the lateral wellbore. The tie-back assembly has a tie-back window formed therein, whereby when the tie-back assembly is disposed into the main wellbore, the lateral liner and a portion of the tie-back assembly are deflected into the lateral wellbore by the deflecting surface such that the tie-back window aligns with the longitudinal bore of the whipstock.

Technical advantages of one or more embodiments may include more cost-effective tie-back systems that provide increased strength against collapse of a lateral wellbore junction. In one embodiment, a tie-back system allows a 4¾" lateral wellbore to be drilled through a window in a 5½" casing and subsequently cased with a liner having a uniform outside diameter that is only slightly less than 4¾". In this embodiment, a whipstock that is used to drill and case the lateral includes a latching mechanism that mechanically couples the tie-back assembly thereto. The whipstock may also include a concentric bore therethrough to allow tools to more easily pass through for coal dust removal or other well treatment operations. Further, this embodiment eliminates the need for an additional whipstock to be used to enter the lateral wellbore, which saves time and costs by avoiding additional trips into the well.

In certain embodiments, a tie-back system having a pre-milled window aligns with the bore in the whipstock to allow access to the main wellbore past the whipstock as the tie-back system is being placed. The tie-back system includes a swivel that allows angular misalignment, but not rotational misalignment, in order to align the window to the bore. A latching system at the end of the tie-back system and the casing liner mechanically locks the tie-back system in place. In this embodiment, the whipstock stays in place and, consequently, no additional whipstock is needed to enter the lateral wellbore, which saves a trip into the well.

The above and elsewhere described technical advantages may be provided and/or evidenced by some, all or none of the various embodiments. In addition, other technical advantages may be readily apparent from the following figures, descriptions, and claims.

DETAILED DESCRIPTION OF THE INVENTION

Figure 1:
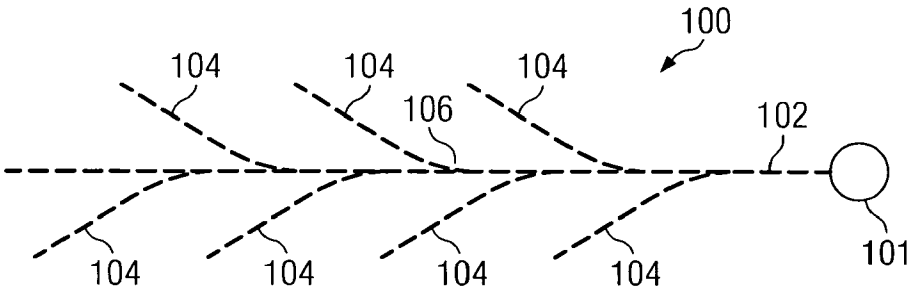
FIG. 1 is a plan diagram illustrating a pinnate drainage pattern for accessing deposits in a subterranean zone in accordance with one embodiment of the invention.

FIG. 1 is a plan diagram illustrating a drainage pattern 100 for accessing deposits in a coal seam or other suitable subterranean zone in accordance with one embodiment of the invention. In the illustrated embodiment, drainage pattern 100 comprises a vertical well bore 101 extending from a surface down to a main well bore 102 disposed within a subterranean zone, and a plurality of lateral well bores 104 extending from main well bore 102. Although drainage pattern 100 is in the form of a pattern of substantially equal length lateral well bores 104, the present invention contemplates other suitable drainage patterns for use within the teachings of the present invention, for example a pinnate pattern. Vertical well bore 101, main well bore 102, and lateral well bores 104 may be formed using any suitable drilling techniques and may be formed with any suitable diameters and lengths.

The drilling of lateral wellbores 104 from main wellbore 102 result in a plurality of wellbore junctions 106. Because the angles of lateral wellbores 104 with respect to main wellbore 102 is typically no more than approximately ten degrees, problems may arise with regard to the collapsing of wellbore junctions 106, especially in subterranean formations such as coal seams. In order to minimize the potential problems of collapsing of wellbore junctions 106, wellbore junctions 106 may be lined with tie-back assemblies when lining lateral wellbores 104. Two such tie-back assemblies for supporting a particular wellbore junction 106 are shown and described below in conjunction with FIGS. 3 through 4 and FIGS. 5 through 6, respectively. An example wellbore junction 106 is illustrated below in conjunction with FIG. 2.

Figure 2:
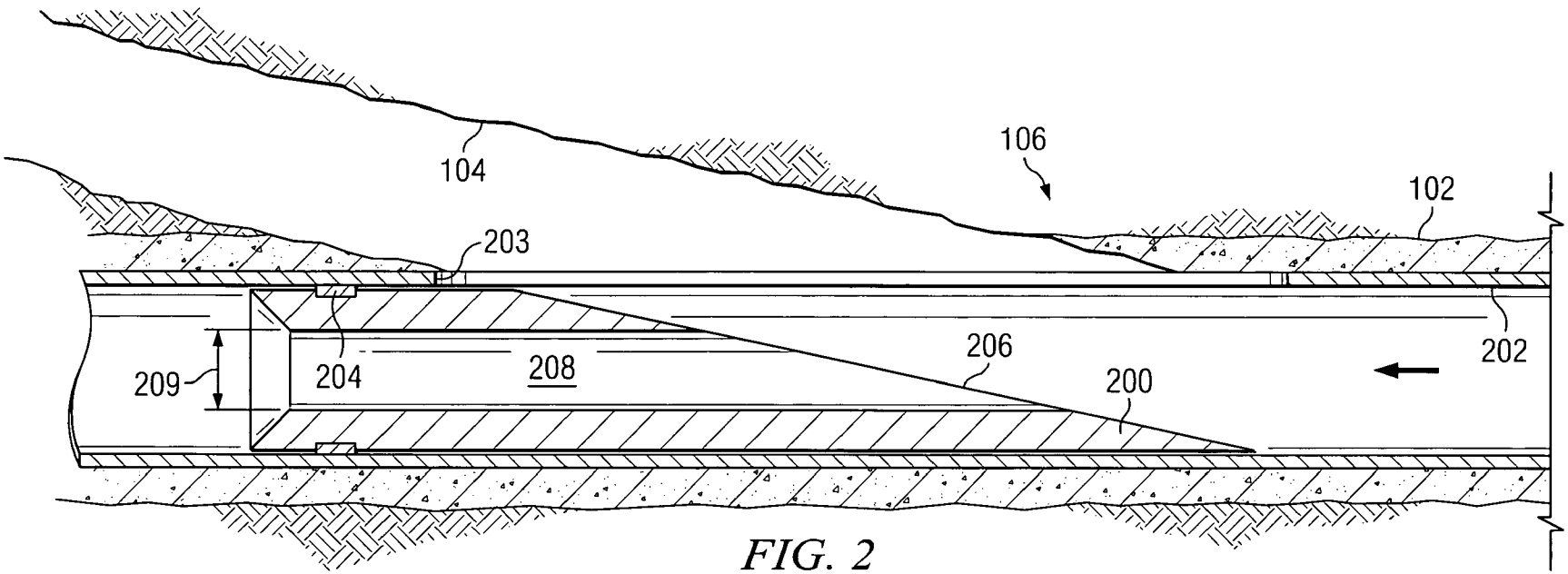
FIG. 2 is a cross-sectional view of a whipstock disposed within a portion of a main wellbore, and a lateral wellbore drilled using the whipstock according to one embodiment of the invention.

FIG. 2 is a cross-sectional view of an example wellbore junction 106 according to one embodiment of the invention. As illustrated in FIG. 2, a main casing 202 is utilized to line main wellbore 102 using any suitable casing techniques well known in the industry. Main casing 202 may be a perforated liner, a slotted liner, or other suitable liner. In one embodiment, main casing 202 includes an outside diameter of approximately five and one-half inches; however, other suitable diameters may be utilized for main casing 202. Main casing 202 includes a plurality of lateral wellbore windows 203 (only one of which is shown in FIG. 2) that may be pre-milled before or milled after main casing 202 is disposed within main wellbore 102. Lateral wellbore window 203 functions to allow lateral wellbore 104 to be drilled off of main wellbore 102. In order to drill lateral wellbore 104, a whipstock 200 is disposed within main casing 202 adjacent wellbore junction 106. Whipstock 200 may be positioned adjacent wellbore junction 106 using any suitable method. In addition, whipstock 200 may be coupled to main casing 202 using any suitable method, such as a suitable latching mechanism 204. Latching mechanism 204 may also function to align whipstock 200 in such a manner that a deflecting surface 206 of whipstock 200 is suitably positioned within main casing 202 in order to adequately direct a drill bit or other suitable drilling mechanism through lateral wellbore window 203 in order to drill lateral wellbore 104. In one embodiment, deflecting surface 206 extends around the full perimeter of whipstock 200. In the illustrated embodiment, lateral wellbore 104 includes a diameter of approximately four and three-quarter inches; however, other suitable diameters are contemplated by the present invention.

In particular embodiments, whipstock 200 includes a longitudinal bore 208 running therethrough that functions to allow access to main wellbore 102 below whipstock 200. Longitudinal bore 208 may or may not be concentric with an outside diameter of whipstock 200. Although longitudinal bore 208 may have any suitable diameter, in one embodiment a diameter 209 of longitudinal bore 208 is approximately 2.44 inches. Whipstock 200 may be suitably positioned within main casing 202 using any suitable techniques. In situations where lateral wellbore 104 is the farthest lateral wellbore 104 from vertical wellbore 101 (FIG. 1), whipstock 200 may be run-in-place. Lateral wellbore 104 is then ready to be drilled and then lined and wellbore junction 106 is ready to be otherwise completed with a suitable tie-back assembly. One such system for facilitating these operations is described below in conjunction with FIGS. 3 and 4.

Figure 3:
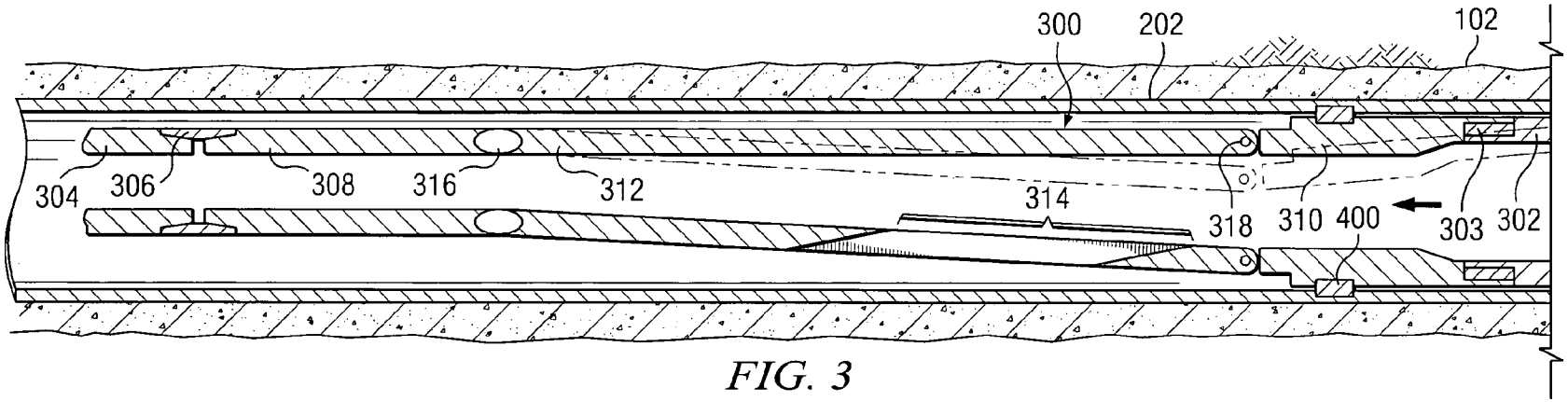
FIG. 3 is a cross-sectional view of a tie-back assembly disposed within another portion of the main wellbore of FIG. 2 according to one embodiment of the invention.

FIG. 3 is a cross-sectional view of a tie-back assembly 300 disposed within main casing 202 at a location within main wellbore 102 away from wellbore junction 106 according to one embodiment of the invention. Tie-back assembly 300, which may be formed form one or more circular tubes or other suitable hollow structures, may be run-in-hole using any suitable method. In the illustrated embodiment, a running tool 302 using any suitable locking mechanism 303 is utilized to run tie-back assembly 300 and lateral liner 304 down through main casing 202. As described above, tie-back assembly 300 is utilized to line lateral wellbore 104 with a lateral liner 304 and to provide collapse resistance for wellbore junction 106 (FIG. 2). In the illustrated embodiment, tie-back assembly 300 includes a lower section 308, an upper section 310, and an intermediate section 312 disposed between lower section 308 and upper section 310.

Lower section 308 couples to lateral liner 304 via a tube coupling 306 or other suitable coupling. In an embodiment where lateral wellbore 104 has a diameter of approximately four and three-quarters inches, lateral liner 304 includes an outside diameter of approximately two and seven-eighths inches. However, other suitable diameters may be utilized for lateral liner 304. In another embodiment, a three and one-half inch outside diameter lateral liner 304 is utilized. Although lower section 308 may have any suitable diameter, it is preferable that lower section 308 have a diameter that substantially matches a diameter of lateral liner 304.

Intermediate section 312 includes a tie-back window 314 formed therein that aligns with longitudinal bore 208 of whipstock 200 (FIG. 2) when tie-back assembly 300 is fully installed. This is described in more detail below in conjunction with FIG. 4. Tie-back window 314 may have any suitable shape and any suitable dimensions; however, in order for tie-back window 314 to align with longitudinal bore 208 to allow access past whipstock 200 (FIG. 2), tie-back window 314 is generally oval-shaped. Intermediate section 312 may have any suitable length and any suitable diameter. In one embodiment, intermediate section 312 includes a diameter that gradually decreases from upper section 310 to lower section 308. In addition, intermediate section 312 may have any suitable configuration. For example, as illustrated by dashed line 315, intermediate section 312 may be cylindrically shaped so as to allow lateral liner 304, lower section 308, and a portion of intermediate section 312 to enter lateral wellbore 104 more easily.

Intermediate section 312 may couple to lower section 308 using any suitable method; however, in the illustrated embodiment, a lower swivel 316 functions to couple intermediate section 312 to lower section 308. Lower swivel 316, in one embodiment, functions to allow angular and rotational movement of intermediate section 312 relative to lower section 308. This facilitates lateral liner 304 staying substantially stationary within lateral wellbore 104 as intermediate section 312 is either rotated and/or angled in some manner.

Upper section 310 couples to intermediate section 312 in any suitable manner; however, in the illustrated embodiment, an upper swivel 318 is utilized. Upper swivel 318, in one embodiment, allows only angular movement of intermediate section 312 relative to upper section 310. Therefore, when upper section 310 is rotated, then intermediate section 312 is also rotated. However, when intermediate section 312 is angled in some manner, then upper section 310 remains in substantially the same position. Upper section 312 may have any suitable diameter and any suitable length. In one embodiment, upper section 310 includes an outside diameter of approximately four and a half inches so that it may fit within a five and one-half inches diameter main casing 202.

Figure 4:
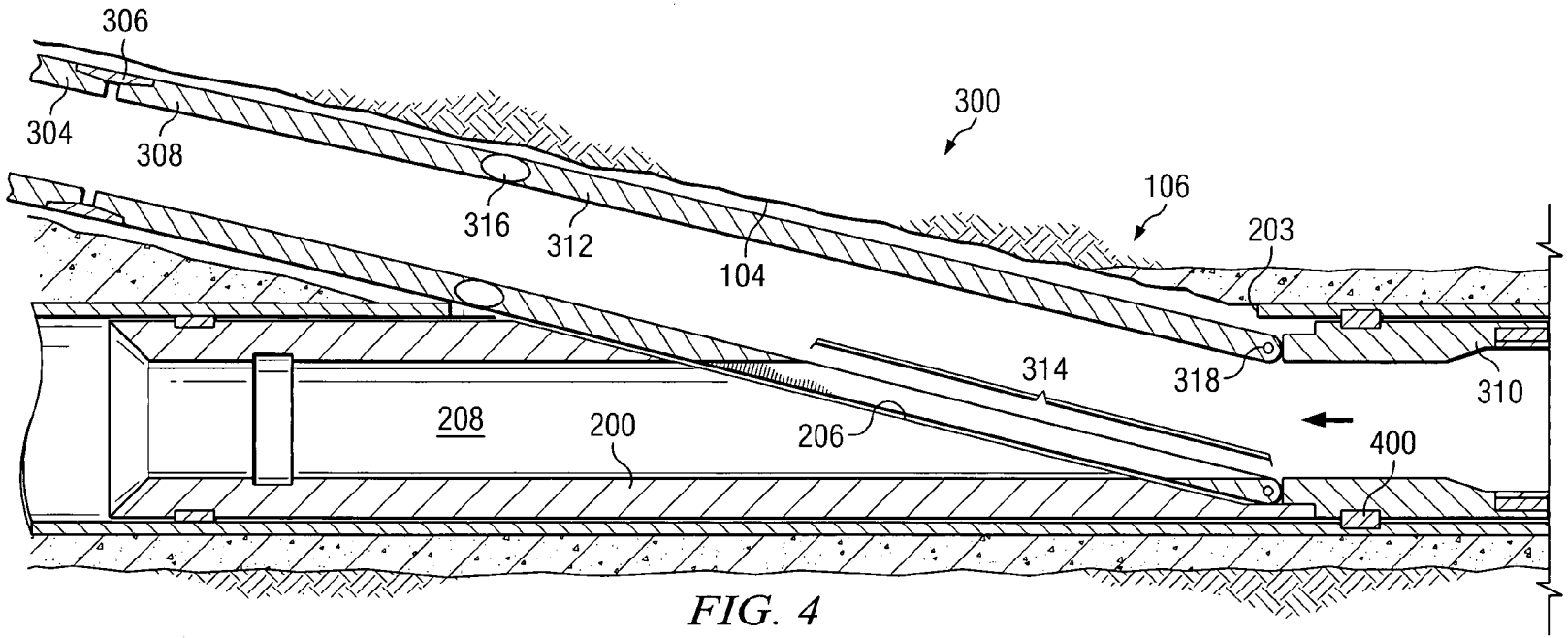
FIG. 4 is a cross-sectional view illustrating the installation of the tie-back assembly of FIG. 3 within the main wellbore proximate the whipstock according to one embodiment of the invention.

FIG. 4 is a cross-sectional view of a particular wellbore junction 106 illustrating the installation of tie-back assembly 300 according to one embodiment of the invention. As illustrated, lateral liner 304 is disposed within lateral wellbore 104. The insertion of lateral liner 304 within lateral wellbore 104 is facilitated by deflecting surface 206 of whipstock 200. Briefly, an end (not explicitly shown) of lateral liner 304 engages deflecting surface 206 of whipstock 200 and is deflected through lateral wellbore window 203 and into lateral wellbore 104. In one embodiment, this is facilitated by having the end of lateral liner 304 with an outside diameter that is at least slightly greater than the diameter of longitudinal bore 208. This assures the correct deflection of lateral liner 304 through lateral wellbore window 203. In one embodiment, the end of lateral liner 304 includes a suitable cap, such as a bullnose, to facilitate the guiding of lateral liner 304 into lateral wellbore 104. Because lateral liner 304 is typically very long, lateral liner 304 is formed from a material that allows some flexing of lateral liner 304 as it is being installed into lateral wellbore 104. As tie-back assembly 300 approaches wellbore junction 106, lower swivel 316 allows for any angular misalignment between lower section 308 and intermediate section 312 of tie-back assembly 300.

A portion of tie-back assembly 300 is also inserted through lateral wellbore window 203 and into lateral wellbore 104. Tie-back assembly 300 is fully installed when tie-back window 314 of intermediate portion 312 aligns with longitudinal bore 208 of whipstock 200 as illustrated. The running tool 302 that is installing tie-back assembly 300 may have to be rotated in order to align tie-back window 314 with longitudinal bore 208. In other embodiments, a muleshoe-type device may provide rotation and alignment. Although any suitable alignment technique may be utilized, a latching mechanism 400 may be utilized to help align tie-back window 314 with longitudinal bore 208 in addition to coupling upper section 310 to main casing 202. Any suitable latching mechanism may be utilized. Because upper swivel 318 allows only angular movement of intermediate section 312 relative to upper section 310, intermediate section 312 is also rotated when upper section 310 is rotated by running tool 302 or a muleshoe-type sleeve. This helps to align tie-back window 314 with longitudinal bore 208. Any gap resulting after the installation of tie-back assembly 300 due to lateral wellbore window 203 may be covered with any suitable closing gate (not shown).

Thus, the alignment of tie-back window 314 with longitudinal bore 208 allows access to main wellbore 102 below whipstock 200. Tools may then be run through longitudinal bore 208 to perform any suitable operation to main wellbore 102 below whipstock 200, such as the removing of coal seam dust.

Although FIGS. 3 through 4 illustrate the lining of a particular lateral wellbore 104 and completion of its respective wellbore junction 106, the other remaining lateral wellbores 104 and wellbore junctions 106 (see FIG. 1) are lined and completed in a similar manner as illustrated in FIGS. 3 and 4. The sequence of lining operations according to one embodiment is to start with the lateral wellbore 104 that is farthest from the surface and work backwards towards the surface. Because whipstocks 200 are left in place, they may be utilized to re-enter any of the lateral wellbores 104 in order to form any operations within a respective lateral wellbore 104. This eliminates having to install an additional whipstock into main casing 202, which saves a trip into the well. Another system for facilitating the lining of lateral wellbores 104 and completing of wellbore junctions 106 is described below in conjunction with FIGS. 5 and 6.

Figure 5:
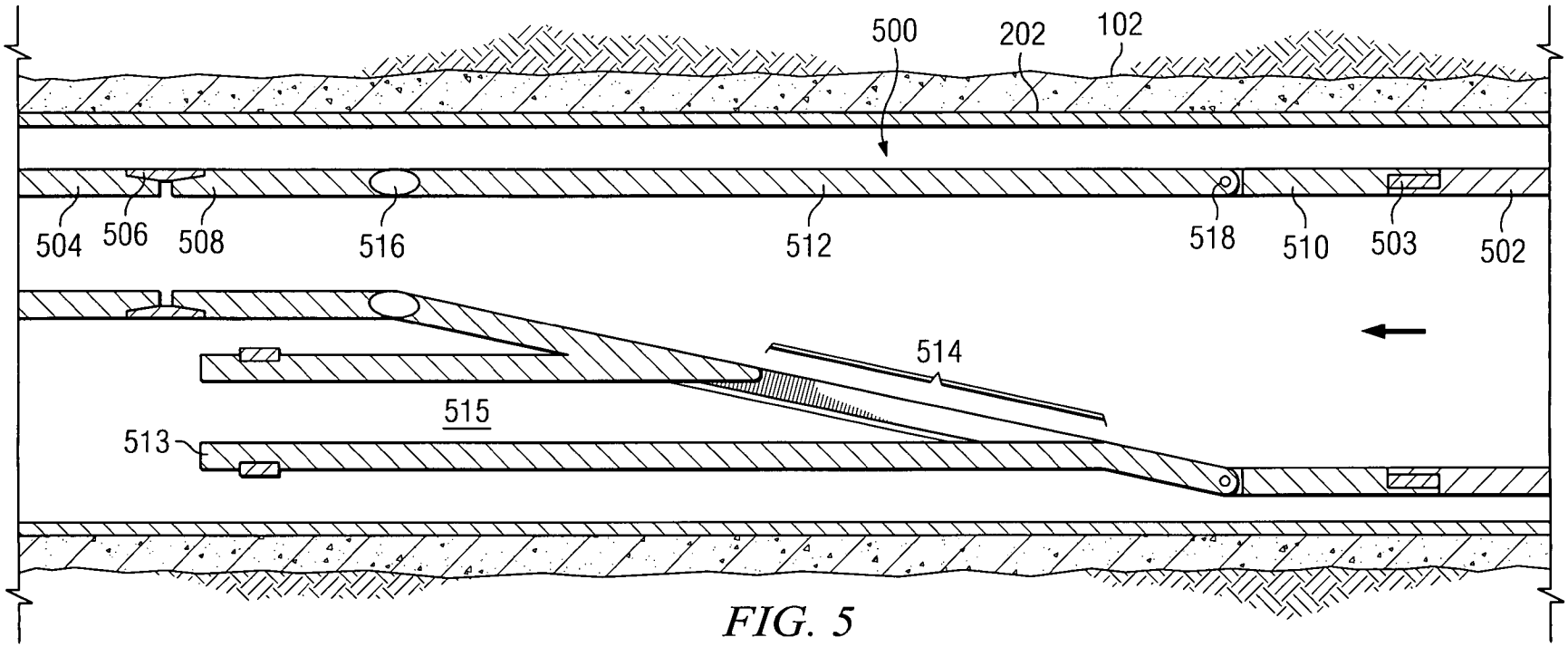
FIG. 5 is a cross-sectional view of a tie-back assembly disposed within the portion of the main wellbore of FIG. 2 according to another embodiment of the invention.

FIG. 5 is a cross-sectional view of a tie-back assembly 500 disposed within main casing 202 according to another embodiment of the invention. Tie-back assembly 500, which may be formed form one or more circular tubes or other suitable hollow structures, may be run-in-hole using any suitable method, such as a running tool and suitable locking mechanism as described above. Tie-back assembly 500 is utilized to line a particular lateral wellbore 104 with a lateral liner 504 and to provide collapse resistance for its associated wellbore junction 106 (FIG. 2). In the illustrated embodiment, tie-back assembly 500 includes a lower section 508, an upper section 510, an intermediate section 512 disposed between lower section 508 and upper section 510, and a nose section 513 coupled to intermediate section 512.

Lower section 508 couples to lateral liner 504 via a tube coupling 506 or other suitable coupling. In an embodiment where lateral wellbore 104 has a diameter of approximately four and three-quarters inches, lateral liner 504 includes an outside diameter of approximately two and seven-eighths inches. However, other suitable diameters may be utilized for lateral liner 504. In another embodiment, a three and one-half inch outside diameter lateral liner 504 is utilized. Although lower section 508 may have any suitable diameter, it is preferable that lower section 508 have a diameter that substantially matches a diameter of lateral liner 504.

Intermediate section 512 includes a tie-back window 514 formed therein that is aligned with a bore 515 of nose section 513. Therefore, when tie-back assembly 500 is fully installed, tie-back window 514 and bore 515 of nose section 513 align with longitudinal bore 208 of whipstock 200 (FIG. 2). This is illustrated best in FIG. 6. Tie-back window 514 may have any suitable shape and any suitable dimensions; however, because intermediate section 512 is angled with respect to bore 515, tie-back window 514 is generally oval-shaped. Intermediate section 512 may have any suitable length and any suitable diameter. Because nose section is coupled to intermediate section 512 and fits within longitudinal bore 208 (as described below), intermediate section 512 includes a diameter that gradually decreases from upper section 510 to lower section 508.

Nose section 513 couples to intermediate section 512 in any suitable manner. In addition, nose section 513 may have any suitable length and diameter. However, since nose section 513 is disposed within longitudinal bore 208 of whipstock 200 when tie-back assembly is fully installed, nose section 513 typically has a length shorter than the length of whipstock 200 and an outside diameter equal to or slightly less than the diameter of longitudinal bore 208. Nose section 513 functions to provide additional collapse resistance to wellbore junction 106 and to help align tie-back assembly 500 when being installed.

Intermediate section 512 may couple to lower section 508 using any suitable method; however, in the illustrated embodiment, a lower swivel 516 functions to couple intermediate section 512 to lower section 508. Lower swivel 516, in one embodiment, functions to allow angular and rotational movement of intermediate section 512 relative to lower section 508. This facilitates lateral liner 504 staying substantially stationary within lateral wellbore 104 as intermediate section 512 is either rotated and/or angled in some manner.

Upper section 510 couples to intermediate section 512 in any suitable manner; however, in the illustrated embodiment, an upper swivel 518 is utilized. Upper swivel 518, in one embodiment, allows only angular movement of intermediate section 512 relative to upper section 510. Therefore, when upper section 510 is rotated, then intermediate section 512 is also rotated. However, when intermediate section 512 is angled in some manner, then upper section 510 remains in substantially the same position. Upper section 512 may have any suitable diameter and any suitable length. In one embodiment, upper section 510 includes an outside diameter of approximately four and a half inches so that it may fit within a five and one-half inches diameter main casing 202.

Figure 6:
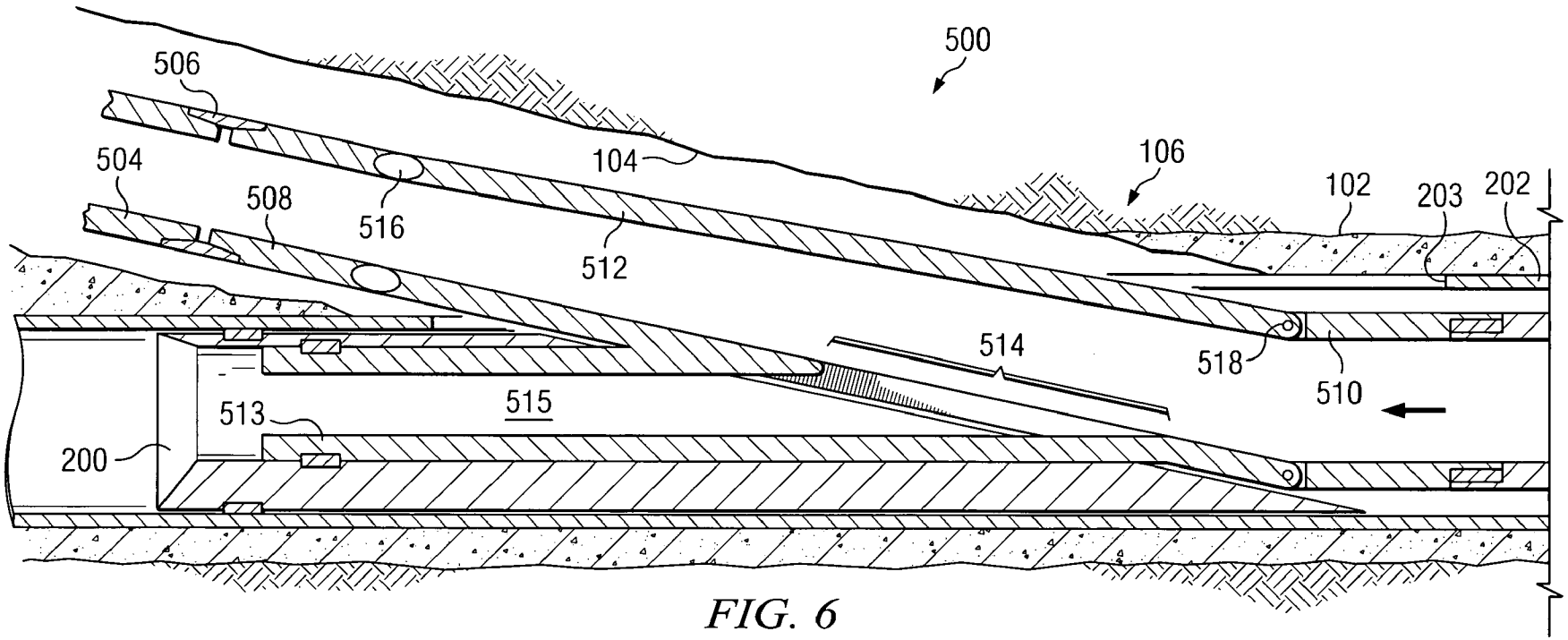
FIG. 6 is a cross-sectional view illustrating the installation of the tie-back assembly of FIG. 5 within the main wellbore proximate the whipstock according to another embodiment of the invention.

FIG. 6 is a cross-sectional view of a particular wellbore junction 106 illustrating the installation of tie-back assembly 500 according to one embodiment of the invention. As illustrated, lateral liner 504 is disposed within lateral wellbore 104. The insertion of lateral liner 504 within lateral wellbore 104 is facilitated by deflecting surface 206 of whipstock 200. Briefly, an end (not explicitly shown) of lateral liner 504 engages deflecting surface 206 of whipstock 200 and is deflected through lateral wellbore window 203 and into lateral wellbore 104. In one embodiment, this is facilitated by having the end of lateral liner 504 with an outside diameter that is at least slightly greater than the diameter of longitudinal bore 208. This assures the correct deflection of lateral liner 504 through lateral wellbore window 203. In one embodiment, the end of lateral liner 504 includes a suitable cap, such as a bullnose, to facilitate the guiding of lateral liner 504 into lateral wellbore 104. Because lateral liner 504 is typically very long, lateral liner 504 is formed from a material that allows some flexing of lateral liner 504 as it is being installed into lateral wellbore 104. As tie-back assembly 500 approaches wellbore junction 106, lower swivel 516 allows for any angular misalignment between lower section 508 and intermediate section 512 of tie-back assembly 500.

A portion of tie-back assembly 500 is also inserted through lateral wellbore window 203 and into lateral wellbore 104. Tie-back assembly 500 is fully installed when nose section 513 is inserted into longitudinal bore 208 of whipstock 200 as illustrated. The running tool that is installing tie-back assembly 500 may have to be rotated slightly in order to align tie-back window 514 with longitudinal bore 208. A latching mechanism 400 may be utilized to couple upper section 510 to main casing 202. Any suitable latching mechanism may be utilized. Because upper swivel 518 allows only angular movement of intermediate section 512 relative to upper section 510, intermediate section 512 is also rotated when upper section 510 is rotated by running tool 502 or a muleshoe sleeve type device. This helps to align nose section 513 with longitudinal bore 208. Any gap resulting after the installation of tie-back assembly 500 due to lateral wellbore window 203 may be covered with any suitable closing gate (not shown).

Thus, the alignment of tie-back window 514 and nose section 513 with longitudinal bore 208 allows access to main wellbore 102 below whipstock 200. Tools may then be run through nose section 513 and longitudinal bore 208 to perform any suitable operation to main wellbore 102 below whipstock 200, such as the removing of coal seam dust.

Although FIGS. 5 through 6 illustrate the lining of a particular lateral wellbore 104 and completion of its respective wellbore junction 106, the other remaining lateral wellbores 104 and wellbore junctions 106 (see FIG. 1) are lined and completed in a similar manner as illustrated in FIGS. 5 and 6. Because whipstocks 200 are left in place, they may be utilized to re-enter any of the lateral wellbores 104 in order to form any operations within a respective lateral wellbore 104. This eliminates having to install an additional whipstock into main casing 202, which saves a trip into the well.

Figure 7:
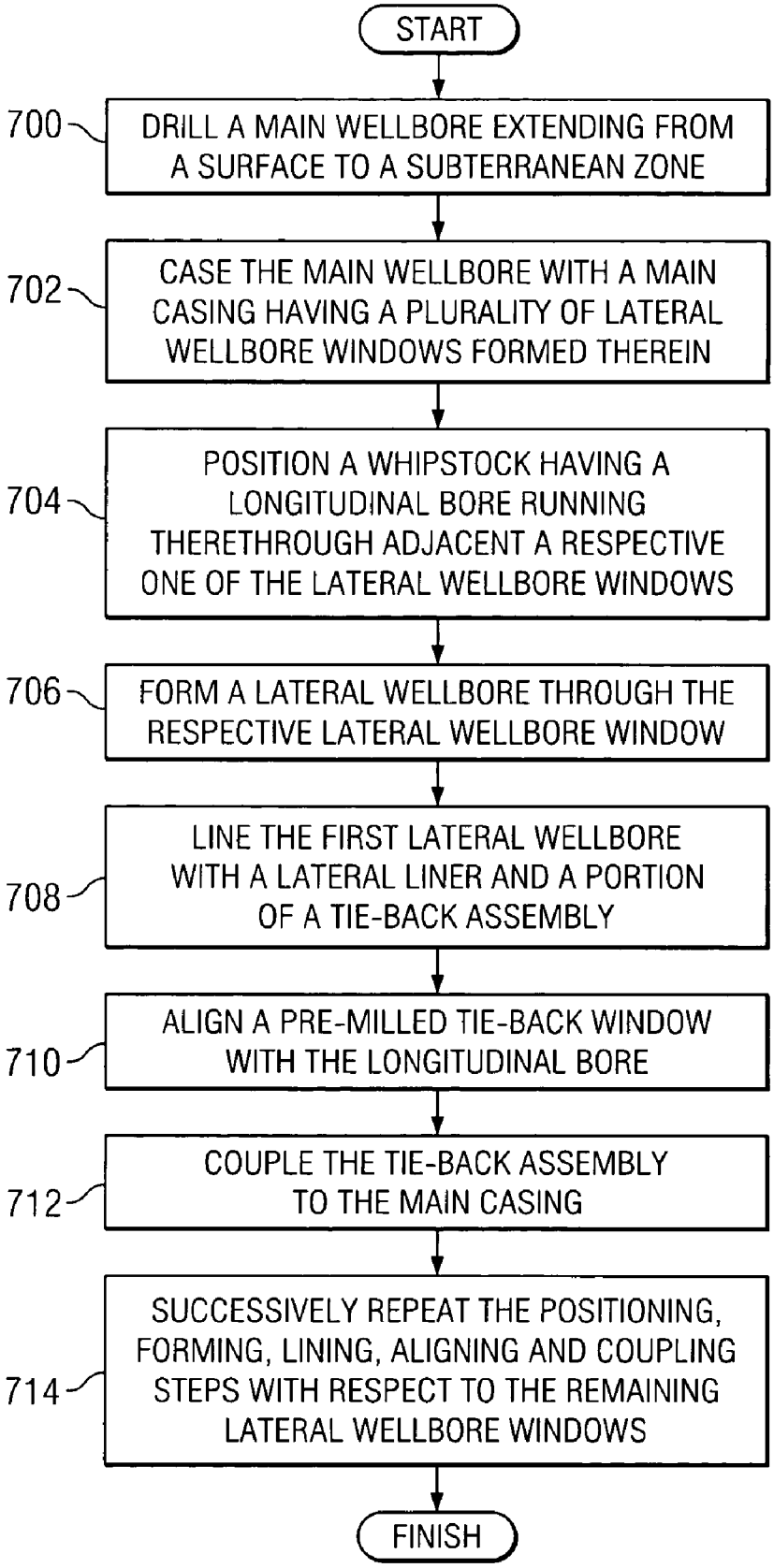
FIG. 7 is a flowchart illustrating a method of lining a lateral wellbore according to one embodiment of the invention.

FIG. 7 is a flowchart illustrating an example method of lining a lateral wellbore 104 according to one embodiment of the invention. The method begins at step 700 where main wellbore 102 extending from a surface to a subterranean zone is drilled. As described above, any suitable drilling method may be utilized. Main wellbore 102 is cased with main casing 202 at step 702. Main casing 202 includes a plurality of lateral wellbore windows 203 formed therein that facilitate the drilling of a plurality of lateral wellbores 104 from main wellbore 102. In some embodiments, there may be an additional step (not illustrated) in which main wellbore 102 is cased with a string with no windows and then the main leg of the multilateral (near horizontal wellbore) is drilled in the subterranean zone and then cased with a casing that includes the window sections. This casing may not necessarily extend back to the surface but may overlap the first casing run from surface.

Whipstock 200 is positioned adjacent a respective one of the lateral wellbore windows 203 at step 704. As described above, whipstock 200 has longitudinal bore 208 running therethrough that allows access to main wellbore 102 below whipstock 200. Whipstock 200 may be positioned using any suitable method. A lateral wellbore 104 is formed through the respective lateral wellbore window 203, as denoted by step 706. This forms a wellbore junction 106.

Lateral wellbore 104 is then lined with a lateral liner and a portion of a tie-back assembly, as denoted by step 708. Examples of this lining step are described above in conjunction with FIGS. 3 through 4 and FIGS. 5 and 6. A tie-back window of the tie-back assembly is aligned with a longitudinal bore of the whipstock at step 710. This may include rotating portions of the tie-back assembly or other suitable manipulation in order to facilitate the aligning. The tie-back assembly is then coupled to a main casing with a suitable latching mechanism at step 712. The positioning of the whipstock, forming of lateral wellbore 104, lining of lateral wellbore 104, aligning of the tie-back window with the longitudinal bore, and coupling of a tie-back assembly to the main casing is then repeated for each additional lateral wellbore window formed in the main casing, as denoted by step 714. The drainage pattern 100 is then ready for subsequent production or other suitable operation. That ends the example method as illustrated in FIG. 7.

Although the present invention has been described with several embodiments, various changes and modifications may be suggested to one skilled in the art. It is intended that the present invention encompass such changes and modifications as fall within the scope of the appended claims and their equivalence.

What is claimed is:

1. A system for lining a lateral wellbore, comprising:

a main casing having a lateral wellbore window formed therein disposed within a main wellbore;

a whipstock having a longitudinal bore running therethrough and disposed within the main wellbore adjacent the lateral wellbore window, the whipstock comprising a deflecting surface for forming a lateral wellbore through the lateral wellbore window;

a tie-back assembly operable to dispose a lateral liner within the lateral wellbore, the tie-back assembly having a tie-back window formed therein; and a latch mechanism operable to couple the tie-back assembly directly to the main casing and align the tie-back window with the longitudinal bore of the whipstock;

the deflecting surface being configured so that when the tie-back assembly is disposed into the main wellbore, the lateral liner and a portion of the tie-back assembly are deflected into the lateral wellbore by the deflecting surface that the tie-back window aligns with the longitudinal bore of the whipstock.

2. The system of claim 1, further comprising a latching mechanism operable to couple the whipstock to an inside surface of the main casing and align the deflecting surface with the lateral wellbore window.

3. The system of claim 1, wherein the longitudinal bore of the whipstock is concentric with an outside diameter of the whipstock.

4. The system of claim 1, wherein the tie-back assembly comprises:

a lower section configured to couple to the lateral liner;

an upper section configured to couple to the main casing; and an intermediate section disposed between the lower and upper sections;

a first swivel coupling the intermediate section to the lower section, the first swivel operable to allow angular and rotational movement of the intermediate section relative to the lower section; and a second swivel coupling the intermediate section to the upper section, the second swivel operable to allow only angular movement of the intermediate section relative to the upper section.

5. The system of claim 4, wherein the latching mechanism is operable to couple the upper portion to the main casing.

6. The system of claim 1, wherein the deflecting surface extends around the full perimeter of the whipstock.

7. The system of claim 1, wherein an end of the lateral liner comprises an outside diameter that is at least slightly greater than a diameter of the longitudinal bore.

8. The system of claim 1, wherein the main casing comprises an outside diameter of approximately 5½ inches.

9. A method for limiting a lateral wellbore, comprising:

drilling a main wellbore extending from a surface to a subterranean zone;

casing the main wellbore with a main casing having a plurality of lateral wellbore windows formed therein;

positioning a whipstock having a longitudinal bore running therethrough adjacent a respective one of the lateral wellbore windows;

forming a lateral wellbore through the respective lateral wellbore window using the whipstock;

lining the first lateral wellbore with a lateral liner and a portion of a tie-back assembly, the tie-back assembly having a pre-milled lateral wellbore window formed therein;

aligning the pre-milled lateral wellbore window with the longitudinal bore; and coupling the tie-back assembly to the min casing by engaging a latching mechanism that is operable to couple the tie-back assembly directly to the main casing and align the tie-back window with the longitudinal bore of the whipstock.

10. The method of claim 9, further comprising successively repeating the positioning, forming, lining, aligning and coupling steps with respect to the remaining lateral wellbore windows.

11. The method of claim 9, further comprising directing a tool through the lateral wellbore by utilizing the whipstock.

12. The method of claim 9, wherein positioning the whipstock further comprises:

aligning the whipstock such that a deflecting surface of the whipstock faces the respective lateral wellbore window; and coupling the whipstock to the main casing with a latching mechanism.

13. The method of claim 9, wherein aligning the pre-milled lateral wellbore window with the longitudinal bore further comprises rotating the tie-back assembly.

14. The method of claim 9, wherein casing the main wellbore comprises casing the main wellbore with a main casing having an outside diameter of approximately 5½ inches.

15. The method of claim 9, wherein the tie-back assembly further comprises a lower section, an upper section, and an intermediate section disposed between the lower and upper sections, the method further comprising:

allowing angular and rotational movement of the intermediate section relative to the lower section; and allowing only angular movement of the intermediate section relative to the upper section.

16. A method for lining a lateral wellbore, comprising:

drilling a main wellbore extending from a surface to a subterranean zone;

casing the main wellbore with a main casing having a plurality of lateral wellbore windows formed therein;

positioning a whipstock having a longitudinal bore running therethrough adjacent a respective one of the lateral wellbore windows, the whipstock comprising a deflecting surface extending around the full perimeter of the whipstock;

forming a lateral wellbore through the respective lateral wellbore window using the whipstock;

lining the first lateral wellbore with a lateral liner and a portion of a tie-back assembly, the tie-back assembly comprising an intermediate section having a pre-milled lateral wellbore window formed therein;

aligning the pre-milled lateral wellbore window with the longitudinal bore; and coupling the tie-back assembly to the main casing by engaging a latching mechanism that is operable to couple the tie-back assembly directly to the main casing and align the tie-back window with the longitudinal bore of the whipstock.

17. The method of claim 16, further comprising successively repeating the positioning, forming, lining, aligning and coupling steps with respect to the remaining lateral wellbore windows.

18. The method of claim 16, further comprising directing a tool through the lateral wellbore by utilizing the whipstock.

19. The method of claim 16, wherein the longitudinal bore of the whipstock is concentric with an outside diameter of the whipstock.

20. The method of claim 16, wherein positioning the whipstock further comprises:

aligning the whipstock such that the deflecting surface of the whipstock faces the respective lateral wellbore window; and coupling the whipstock to the main casing with a latching mechanism.

21. The method of claim 16, wherein aligning the pre-milled lateral wellbore window with the longitudinal bore further comprises rotating the tie-back assembly.

22. The method of claim 16, wherein the tie-back assembly further comprises a nose section, the method further comprising inserting substantially all of the nose section into the longitudinal bore of the whipstock when aligning the pre-milled lateral wellbore window with the longitudinal bore.

23. The method of claim 16, wherein casing the main wellbore comprises casing the main wellbore with a main casing having an outside diameter of approximately 5½ inches, and wherein forming the lateral wellbore comprises forming a lateral wellbore having an outside diameter of approximately 4¾ inches.

24. The method of claim 16, wherein the tie-back assembly further comprises a lower section, an upper section, and an intermediate nose section, the method further comprising:

allowing angular and rotational movement of the intermediate section relative to the lower section; and allowing only angular movement of the intermediate section relative to the upper section.

25. The method of claim 24, further comprising causing a diameter of the intermediate portion to gradually decrease from the upper section to the lower section.

26. A system, comprising:

a well bore having a casing disposed at least partially therein;

two or more lateral bores coupled to the well bore and extending at least partially into a coal seam, two or more of the lateral bores each having a lateral liner disposed at least partially therein; and a tie-back assembly between one of the lateral liners and the casing, the tie-back assembly having a tie-back window formed therein and a latch mechanism operable to couple the tie-back assembly directly to the main casing and align the tie-back window with a longitudinal bore of the casing.

27. The system of claim 26, further comprising a whipstock in the well bore, the whipstock having a longitudinal bore running therethrough.

28. The system of claim 26, wherein the tieback assembly comprises:

a first section configured to couple to the lateral liner;

a second section configured to couple to the casing;

an intermediate section disposed between the first and second sections;

a first swivel configured to couple the intermediate section to the first section and operable to allow angular and rotational movement of the intermediate section relative to the first section.

29. The system of claim 28, wherein the tieback assembly further comprises a second swivel configured to couple the intermediate section to the second section, the second swivel operable to allow angular and substantially prevent rotational movement of the intermediate section relative to the second section.

30. The system of claim 26, wherein the well bore comprises a substantially horizontal bore.

31. A method, comprising:

positioning a casing within a well bore;

coupling a first lateral liner to the casing, the first lateral liner disposed at least partially in a first lateral well bore that extends at least partially into a coal seam;

coupling the first lateral liner to a tie-back assembly having a tie-back window formed therein;

coupling the tie-back assembly directly to the casing a latching mechanism operable to couple the tieback assembly directly to the main casing and align the tie-back window with a longitudinal bore of the casing; and coupling a second lateral liner to the casing, the second lateral liner disposed at least partially in a second lateral well bore.

32. The method of claim 31, further comprising:

positioning a whipstock in the well bore;

with the whipstock, deflecting a drilling mechanism to drill the first lateral well bore; and passing a tool in the well bore through the whipstock.

33. The method of claim 31, further comprising:

positioning a first whipstock in the well bore;

with the first whipstock, deflecting a drilling mechanism to drill the first lateral well bore;

positioning a second whipstock in the well bore without removing the first whipstock from the well bore; and with the second whipstock, deflecting a drilling mechanism to drill the second lateral well bore.

34. The method of claim 31, wherein coupling a first lateral liner to the casing further comprises:

deflecting the first lateral liner and tieback assembly off of a whipstock positioned in the well bore into the first lateral well bore; and aligning a lateral passage through the tieback assembly with a longitudinally passage through the whipstock.

* * * * *